US005826998A

United States Patent [19]

Shih

[11] Patent Number: 5,826,998

[45] Date of Patent: Oct. 27, 1998

[54] WRITING UTENSIL STRUCTURE WITH PLURAL WHISTLES

[76] Inventor: Chung-Chen Shih, No. 815, Sec. 2, Changshui Rd., Tachu Li, Hsihu Chen, Changhua Hsien, Taiwan

[21] Appl. No.: 929,503

[22] Filed: Sep. 15, 1997

[51] Int. Cl.[6] ..... B43K 29/00

[52] U.S. Cl. ..... 401/52; 401/98; 401/195

[58] Field of Search ..... 401/195, 52, 98; 446/204; 7/160

[56] References Cited

U.S. PATENT DOCUMENTS

| | | | |
|---|---|---|---|
| 256,738 | 4/1882 | Reckendorfer et al. | 7/160 X |
| 2,739,065 | 3/1956 | Hugin | 446/204 X |
| 4,553,926 | 11/1985 | Crespy | 431/253 |

*Primary Examiner*—Steven A. Bratlie
*Attorney, Agent, or Firm*—Dellett and Walters

[57] ABSTRACT

A writing utensil structure includes a body having an upper end portion and a lower end portion defining a first sound emitting nozzle. A spacer is mounted in an inner wall of a mediate portion of the body for closing it, thereby defining an upper chamber and a lower chamber communicating with the first sound emitting nozzle. A first sound diffusing nozzle is defined through an outer wall of the lower end portion of the body and communicates between the lower chamber and the first sound emitting nozzle. A first sound guiding wedge is mounted in an inner wall of the lower end portion of the body and is located diametrically opposite to the first sound diffusing nozzle. By such an arrangement, the writing utensil structure can function as a whistle.

7 Claims, 4 Drawing Sheets

WRITING UTENSIL STRUCTURE WITH PLURAL WHISTLES

FIELD OF THE INVENTION

The present invention relates to a writing utensil structure, and more particularly to a utility writing utensil structure.

BACKGROUND OF THE INVENTION

A conventional writing utensil structure is shown in FIG. 8, and a complete illustration will follow in the detailed description of the preferred embodiments.

The present invention has arisen to mitigate and/or obviate the disadvantage of the conventional writing utensil structure.

SUMMARY OF THE INVENTION

In accordance with one aspect of the present invention, there is provided a writing utensil structure comprising a cylindrical body including an upper end portion and a lower end portion defining a first sound emitting nozzle.

A spacer is fixedly mounted in an inner wall of a mediate portion of the cylindrical body for closing the cylindrical body, thereby defining an upper chamber and a lower chamber communicating with the first sound emitting nozzle.

A first sound diffusing nozzle is defined through an outer wall of the lower end portion of the cylindrical body and communicates between the lower chamber and the first sound emitting nozzle. A first sound guiding wedge is fixedly mounted in an inner wall of the lower end portion of the cylindrical body and is located diametrically opposite to the first sound diffusing nozzle.

A cylindrical end cap is removably mounted on the upper end portion of the cylindrical body and includes an upper end portion and a lower end portion defining a second sound emitting nozzle.

A second sound diffusing nozzle is defined through an outer wall of the upper end portion of the end cap. A second sound guiding wedge is fixedly mounted in an inner wall of a mediate portion of the end cap and is located diametrically opposite to the second sound diffusing nozzle.

Further features of the present invention will become apparent from a careful reading of the detailed description with appropriate reference to the accompanying drawings.

DETAILED DESCRIPTION OF THE PREFERRED EMBODIMENTS

Figure 8:
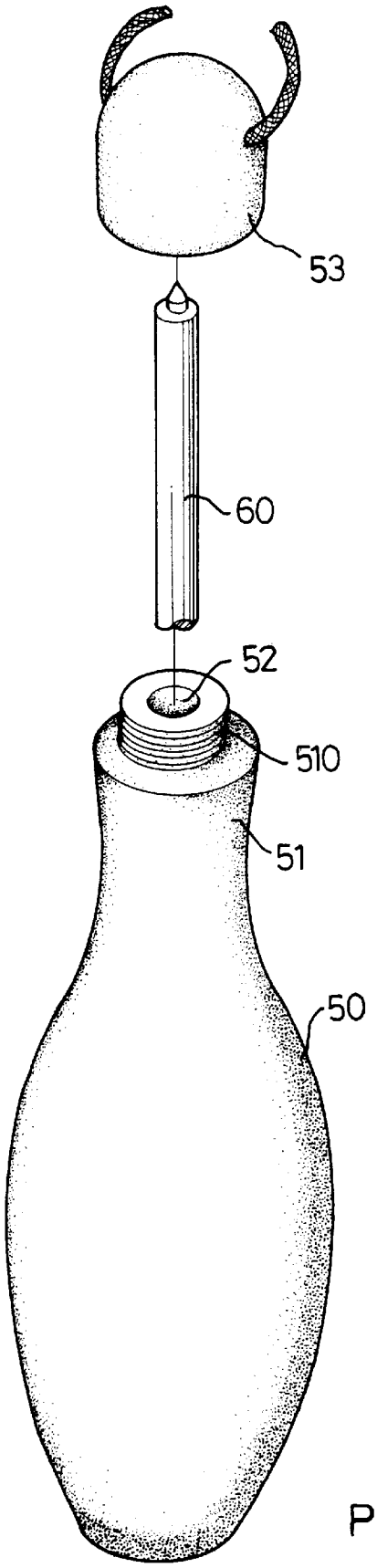
FIG. 8 PRIOR ART
FIG. 8 is an exploded view of a conventional writing utensil structure in accordance with the prior art.

For a better understanding of features and benefits of the present invention, reference is now made to FIG. 8, illustrating a conventional writing utensil structure in accordance with the prior art.

The conventional writing utensil structure comprises a housing 50 having an upper end portion 51 with a threaded neck 510 engaged with an end cap 53, and a writing utensil 60 such as a pen, a pencil and the like received in a passage 52 defined in the housing 50.

By such an arrangement, however, the housing 50 simply functions to receive the pencil 60 therein, thereby greatly limiting the versatility of the writing utensil structure.

Figure 1:
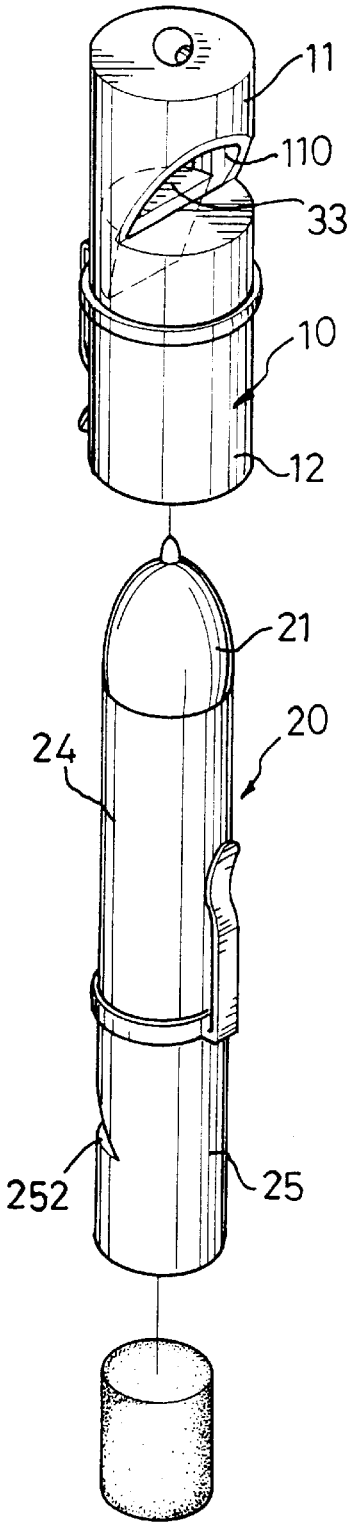
FIG. 1 is an exploded view of a writing utensil structure according to a first embodiment of the present invention.
Figure 2:
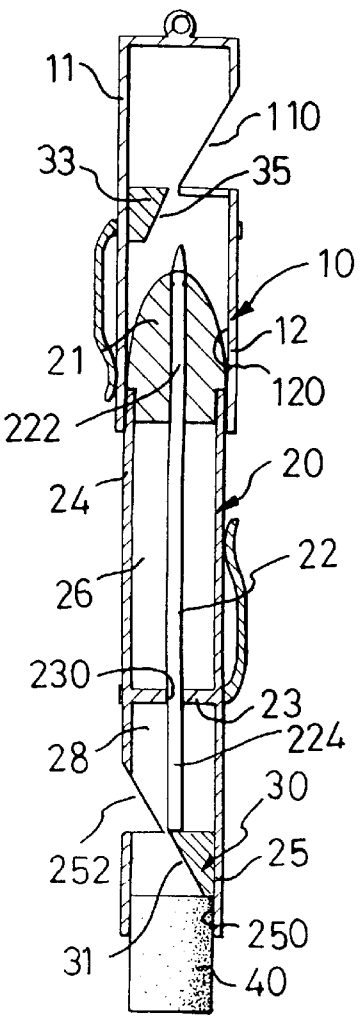
FIG. 2 is a front plan cross-sectional assembly view of the writing utensil structure shown in FIG. 2.

Referring to FIGS. 1 and 2, a writing utensil structure according to a first embodiment of the present invention comprises a cylindrical body 20 including an upper end portion 24 and a lower end portion 25 defining a first sound emitting nozzle 250.

A spacer 23 is fixedly mounted or integrally formed in an inner wall of a mediate portion of the cylindrical body 20 for closing the cylindrical body 20, thereby defining an upper chamber 26 and a lower chamber 28 communicating with the first sound emitting nozzle 250.

A first sound diffusing nozzle 252 is defined through an outer wall of the lower end portion 25 of the cylindrical body 20 and communicates between the lower chamber 28 and the first sound emitting nozzle 250.

A first sound guiding wedge 30 located diametrically opposite to the first sound diffusing nozzle 252 is fixedly mounted in an inner wall of the lower end portion 25 of the cylindrical body 20 and is positioned between the first sound diffusing nozzle 252 and the sound emitting nozzle 250.

The first sound diffusing nozzle 252 has a tapered shape, and the first sound guiding wedge 30 has a tapered surface 31 inclined along a direction toward the first sound diffusing nozzle 252.

A head 21 is mounted on the upper end portion 24 of the cylindrical body 20, and a writing utensil 22 such as a pen, a pencil or the like extends through a bore 230 defined in the spacer 23 and includes an upper end portion 222 extending through the head 21 and a lower end portion 224 abutting on the first sound guiding wedge 30.

A pencil eraser 40 is removably mounted in the first sound emitting nozzle 250 and abuts on the first sound guiding wedge 30.

A cylindrical end cap 10 is removably mounted on the upper end portion 24 of the cylindrical body 20 and includes an upper end portion 11 defining a second sound diffusing nozzle 110 in an outer wall thereof and a lower end portion 12 defining a second sound emitting nozzle 120.

A second sound guiding wedge 33 located diametrically opposite to the second sound diffusing nozzle 110 is fixedly mounted in an inner wall of a mediate portion of the end cap 10 and is positioned between the second sound diffusing nozzle 110 and the second sound emitting nozzle 120. The second sound diffusing nozzle 110 has a tapered shape, and the second sound guiding wedge 33 has a tapered surface 35 inclined along a direction toward the second sound diffusing nozzle 110.

Figure 3:
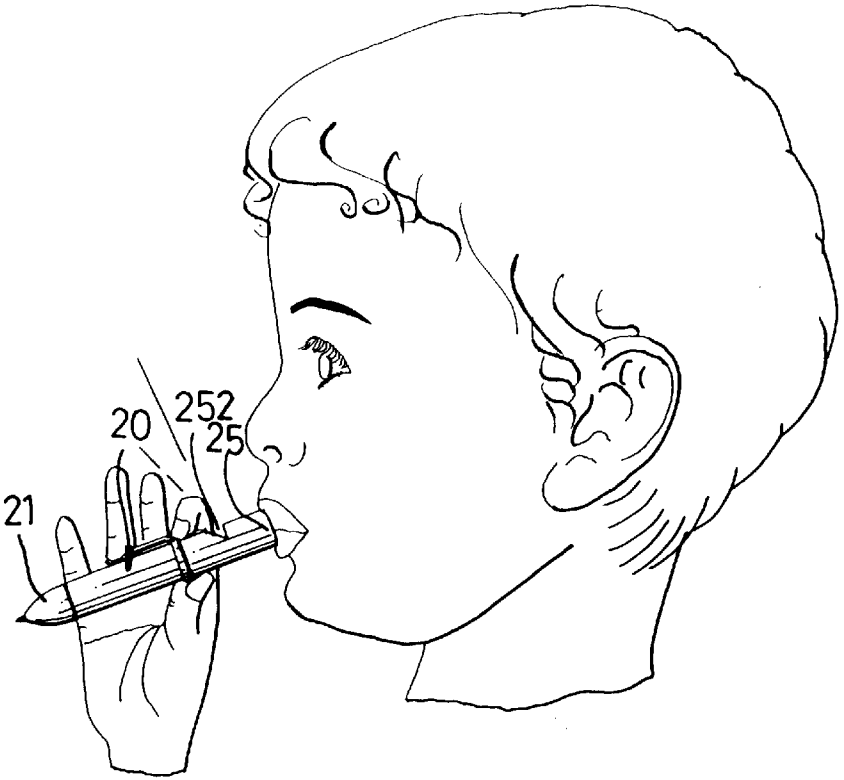

In practice, referring now to FIG. 3 with reference to FIGS. 1 and 2, the pencil eraser 40 can be removed from the lower end portion 25 of the cylindrical body 20 such that a user can blow air into the lower chamber 28 via the first sound emitting nozzle 250 and then into surroundings via the first sound diffusing nozzle 252 by the guidance of the tapered surface 31 of the first sound guiding wedge 30, thereby generating sound such that the cylindrical body 20 of the writing utensil structure can be adapted to function as a whistle.

Figure 4:
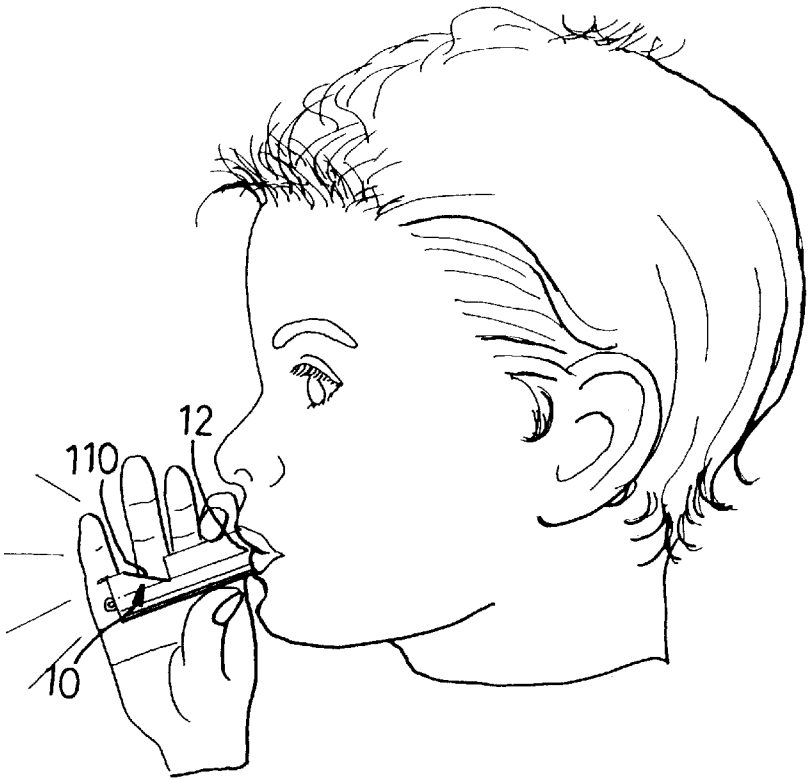
FIGS. 3 and 4 are operational views of the writing utensil structure.

Alternatively, referring to FIG. 4 with reference to FIGS. 1 and 2, the end cap 10 can be removed from the cylindrical body 20 such that a user can blow air into the end cap 10 via the second sound emitting nozzle 120 and then into surroundings via the second sound diffusing nozzle 110 by the guidance of the tapered surface 35 of the second sound guiding wedge 33, thereby generating sound such that the end cap 10 of the writing utensil structure can also be adapted to function as a whistle.

Figure 5:
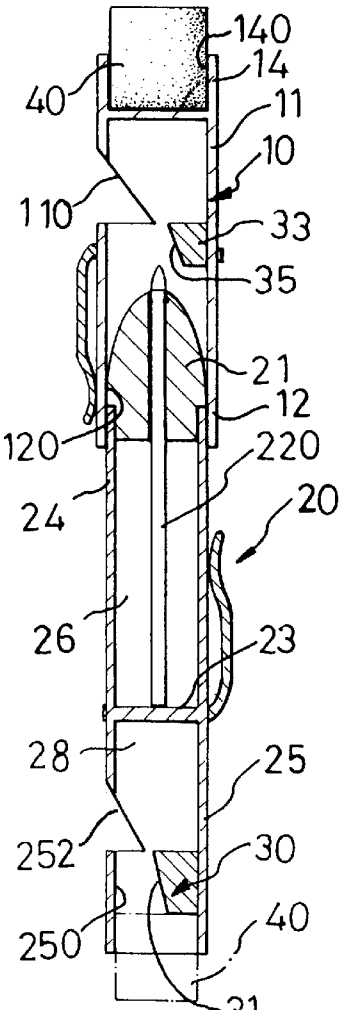
FIG. 5 is a front plan cross-sectional assembly view of a writing utensil structure according to a second embodiment of the present invention.

Referring to FIG. 5 with reference to FIG. 2, according to a second embodiment of the present invention which is similar to the first embodiment, the bore 230 of the spacer 23 is omitted such that a short writing utensil 220 can be received in the upper chamber 26 with its lower end portion abutting on the spacer 23.

In addition, a tubular extension 14 extends from the upper end portion 11 of the end cap 10 and defines a socket 140 therein such that the pencil eraser 40 can be removed from the first sound emitting nozzle 250 to be received in the socket 140.

Figure 6:
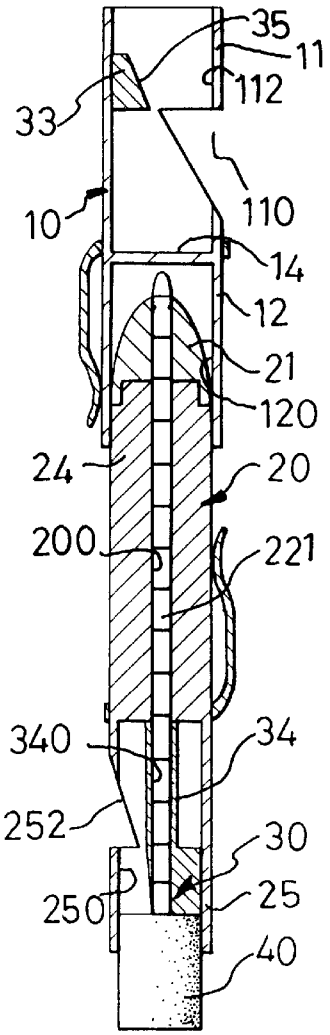
FIG. 6 is a front plan cross-sectional assembly view of a writing utensil structure according to a third embodiment of the present invention.

Referring to FIG. 6, according to a third embodiment of the present invention, the cylindrical body 20 defines a first passage 200 for receiving an item such as a multi-noded pencil 221 therein, and the sound guiding wedge 30 has an elongate extension 34 extending upwardly with a second passage 340 defined therein for receiving a lower end portion of the multi-noded pencil 221.

In addition, a baffle is formed in an inner wall of a mediate portion of the end cap 10, and a sound emitting nozzle 112 is defined in the upper end portion 11 of the end cap 10.

Figure 7:
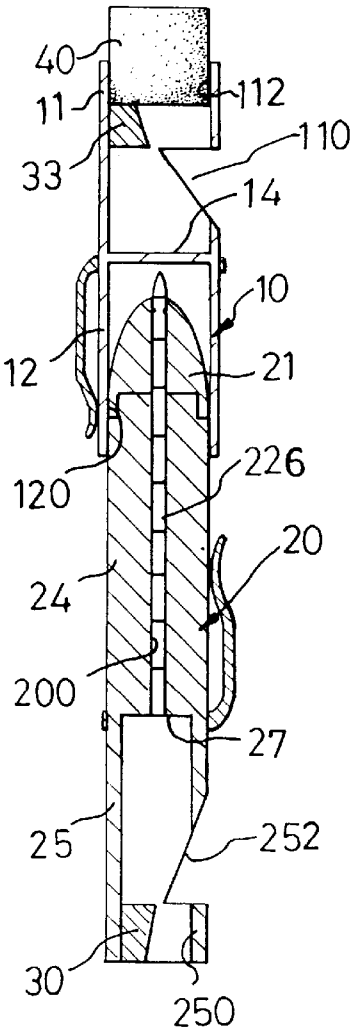
FIG. 7 is a front plan cross-sectional assembly view of a writing utensil structure according to a fourth embodiment of the present invention.

Referring to FIG. 7, according to a fourth embodiment of the present invention which is similar to the third embodiment, a short multi-noded pencil 226 is received in the passage 200 and includes a lower end portion retained by a solid wall 27 formed in the cylindrical body 20.

It should be clear to those skilled in the art that further embodiments of the present invention may be made without departing from the spirit and scope of the present invention.

What is claimed is:

1. A writing utensil structure comprising:

a cylindrical body (20) including an upper end portion (24) and a lower end portion (25) defining a first sound emitting nozzle (250), a spacer (23) fixedly mounted in an inner wall of a mediate portion of said cylindrical body (20) for closing said cylindrical body (20), thereby defining an upper chamber (26) and a lower chamber (28) communicating with said first sound emitting nozzle (250), a first sound diffusing nozzle (252) defined through an outer wall of said lower end portion (25) of said cylindrical body (20) and communicating between said lower chamber (28) and said first sound emitting nozzle (250);

a first sound guiding wedge (30) fixedly mounted in an inner wall of said lower end portion (25) of said cylindrical body (20) and located diametrically opposite to said first sound diffusing nozzle (252);

a cylindrical end cap (10) removably mounted on said upper end portion (24) of said cylindrical body (20) and including an upper end portion (11) and a lower end portion (12) defining a second sound emitting nozzle (120), and a second sound diffusing nozzle (110) defined through an outer wall of said upper end portion (11) of said end cap (10); and a second sound guiding wedge (33) fixedly mounted in an inner wall of a mediate portion of said end cap (10) and located diametrically opposite to said second sound diffusing nozzle (110).

2. The writing utensil structure in accordance with claim 1, wherein said first sound diffusing nozzle (252) has a tapered shape, and said first sound guiding wedge (30) has a tapered surface (31) inclined along a direction toward said first sound diffusing nozzle (252).

3. The writing utensil structure in accordance with claim 1, wherein said second sound diffusing nozzle (110) has a tapered shape, and said second sound guiding wedge (33) has a tapered surface (35) inclined along a direction toward said second sound diffusing nozzle (110).

4. The writing utensil structure in accordance with claim 1, further comprising a pencil eraser (40) removably mounted in said first sound emitting nozzle (250).

5. The writing utensil structure in accordance with claim 1, further comprising a head (21) mounted on said upper end portion (24) of said cylindrical body (20), and a writing utensil (220) received in said upper chamber (26) and including an upper end portion extending through said head (21) and a lower end portion abutting on said spacer (23).

6. The writing utensil structure in accordance with claim 1, wherein said spacer (23) defines a bore (230), a head (21) is mounted on said upper end portion (24) of said cylindrical body (20), and a writing utensil (22) extends through said bore (230) and includes an upper end portion (222) extending through said head (21) and a lower end portion (224) abutting on said first sound guiding wedge (30).

7. The writing utensil structure in accordance with claim 1, wherein a tubular extension (14) extends from said upper end portion (11) of said end cap (10) and defines a socket (140) therein.

* * * * *